US010950072B2

(12) United States Patent
Le et al.

(10) Patent No.: US 10,950,072 B2
(45) **Date of Patent: *Mar. 16, 2021**

(54) ADAPTIVE VEHICLE MONITORING SYSTEM

(71) Applicant: INNOVA ELECTRONICS CORPORATION, Irvine, CA (US)

(72) Inventors: Tan Minh Le, Phu My District (VN); Hung Phan, Anaheim, CA (US); Si Tan Truong, Xuan Loc (VN)

(73) Assignee: Innova Electronics Corporation, Irvine, CA (US)

( * ) Notice: Subject to any disclaimer, the term of this patent is extended or adjusted under 35 U.S.C. 154(b) by 256 days.

This patent is subject to a terminal disclaimer.

(21) Appl. No.: 16/146,577

(22) Filed: Sep. 28, 2018

(65) Prior Publication Data

US 2019/0035180 A1 Jan. 31, 2019

Related U.S. Application Data

(63) Continuation of application No. 15/404,976, filed on Jan. 12, 2017, now Pat. No. 10,163,281.

(51) Int. Cl.
*G07C 5/08* (2006.01)
*G07C 5/00* (2006.01)

(52) U.S. Cl.
CPC ..... *G07C 5/0858* (2013.01); *G07C 5/008* (2013.01); *G07C 5/0808* (2013.01); *G07C 2205/02* (2013.01)

(58) Field of Classification Search
CPC .. G07C 5/0858; G07C 5/008; G07C 2205/02; G07C 5/0808
USPC ..... 701/33.2
See application file for complete search history.

(56) References Cited

U.S. PATENT DOCUMENTS

| | | | |
|---|---|---|---|
| D334,560 | S | 4/1993 | Wilson |
| 5,347,211 | A | 9/1994 | Jakubowski |
| 5,635,841 | A | 6/1997 | Taylor |
| 5,758,300 | A | 5/1998 | Abe |
| 5,767,681 | A | 6/1998 | Huang |
| 5,809,437 | A | 9/1998 | Breed |

(Continued)

FOREIGN PATENT DOCUMENTS

WO WO2001086576 A1 11/2001

*Primary Examiner* — Nadeem Odeh
(74) *Attorney, Agent, or Firm* — Stetina Brunda Garred and Brucker; Mark B. Garred

(57) ABSTRACT

A system and method are provided for adaptively accessing information in a vehicle under test, in a manner to avoid malfunctions associated with accessing the information. A data acquisition device is provided for accessing and retrieving diagnostic data from the vehicle. A memory unit is provided including listing of malfunctioning vehicles, as well as information associated with each of vehicle. At least one service mode request is communicated to the vehicle to identify characteristic information and characteristic features of the vehicle, which information is compared to stored vehicle characteristic information, to determine if the vehicle conforms to any of the listed vehicles, subject to malfunction. If not, additional service requests are communicated to the vehicle. If the vehicle conforms to one or more of the listed vehicles additional service request(s) are modified to remove service requests, or portions thereof, that are associated with the malfunction.

24 Claims, 5 Drawing Sheets

(56) References Cited

U.S. PATENT DOCUMENTS 5,859,628 A 1/1999 Ross et al.
5,884,202 A 3/1999 Arjomand
6,000,413 A 12/1999 Chen
6,055,468 A 4/2000 Kaman et al.
6,225,898 B1 5/2001 Kamiya et al.
6,263,268 B1 7/2001 Nathanson
6,389,337 B1 5/2002 Kolls
6,438,471 B1 8/2002 Katagishi et al.
6,499,385 B2 12/2002 Protti
6,535,112 B1 3/2003 Rothschink
6,587,768 B2 7/2003 Chene et al.
6,611,740 B2 8/2003 Lowrey et al.
6,650,318 B1 11/2003 Arnon
6,718,425 B1 4/2004 Pajakowski et al.
6,732,031 B1 5/2004 Lightner et al.
6,807,469 B2 10/2004 Funkhouser et al.
6,847,916 B1 1/2005 Ying
6,868,369 B2 3/2005 Huang et al.
6,940,270 B2 9/2005 Chen
D510,287 S 10/2005 Chen et al.
6,957,133 B1 10/2005 Hunt et al.
6,968,733 B2 11/2005 Andreasen et al.
7,030,742 B2 4/2006 Treadway
7,085,680 B2 8/2006 Huang
7,116,216 B2 10/2006 Andreasen et al.
7,209,813 B2 4/2007 Namaky
D545,223 S 6/2007 Chen
D559,137 S 1/2008 Protti
D560,129 S 1/2008 Rich et al.
D560,527 S 1/2008 Rich et al.
7,325,775 B2 2/2008 Chen
D563,249 S 3/2008 Chen
7,363,149 B2 4/2008 Klausner et al.
D569,280 S 5/2008 Chen
7,376,497 B2 5/2008 Chen
D571,241 S 6/2008 Andreasen et al.
7,437,227 B2 10/2008 Andreasen et al.
D581,822 S 12/2008 Madison et al.
7,464,000 B2 12/2008 Huang
D588,621 S 3/2009 Baty
D590,387 S 4/2009 Chen
7,520,668 B2 4/2009 Chen
7,603,293 B2 10/2009 Chenn
7,620,484 B1 11/2009 Chen
D610,586 S 2/2010 Chen
7,778,750 B2 8/2010 Knight et al.
D624,446 S 9/2010 Chen et al.
D624,838 S 10/2010 Chen et al.
D625,209 S 10/2010 Chen et al.
D625,210 S 10/2010 Chen et al.
D625,634 S 10/2010 Chen et al.
7,904,219 B1 3/2011 Lowrey et al.
8,019,503 B2 9/2011 Andreasen et al.
8,024,083 B2 9/2011 Chenn
D646,188 S 10/2011 Chen et al.
D646,599 S 10/2011 Chen et al.
8,068,951 B2 11/2011 Chen et al.
8,301,329 B2 10/2012 Andreasen et al.
8,306,687 B2 11/2012 Chen
8,370,018 B2 2/2013 Andreasen et al.
8,509,986 B1 8/2013 Chen
8,600,610 B2 12/2013 Bertosa et al.
8,630,765 B2 1/2014 Chen
8,811,008 B2 8/2014 Selkirk et al.
8,825,270 B2 9/2014 Chen
8,825,271 B2 9/2014 Chen
8,855,621 B2 10/2014 Chen
8,862,117 B2 10/2014 Chen
8,909,416 B2 12/2014 Chen et al.
9,002,554 B2 4/2015 Chen
9,014,908 B2 4/2015 Chen et al.
9,026,400 B2 5/2015 Chen et al.
9,117,319 B2 * 8/2015 Chen ..... G07C 5/008
9,123,051 B2 9/2015 Chen
9,141,503 B1 9/2015 Chen
9,142,066 B2 9/2015 Chen et al.
9,177,428 B2 11/2015 Nguyen et al.
9,183,681 B2 11/2015 Fish
D745,029 S 12/2015 Gray et al.
D746,316 S 12/2015 Gray et al.
D746,323 S 12/2015 Gray et al.
9,213,332 B2 12/2015 Fish et al.
D747,734 S 1/2016 Gray et al.
D749,623 S 2/2016 Gray et al.
9,262,254 B2 2/2016 Bertosa et al.
9,292,977 B2 3/2016 Bertosa et al.
9,324,194 B2 4/2016 Pham
D757,059 S 5/2016 Gray et al.
9,329,633 B2 5/2016 Selkirk et al.
9,342,934 B2 5/2016 Chen
D770,462 S 11/2016 Gray et al.
9,494,125 B2 11/2016 Pham et al.
9,633,492 B2 * 4/2017 Panko ..... G07C 5/0808
9,858,731 B2 1/2018 Fish et al.
9,904,634 B2 2/2018 Case, Jr. et al.
10,295,333 B2 5/2019 Fish et al.
10,467,906 B2 11/2019 Fish et al.
2003/0171111 A1 9/2003 Clark
2004/0110472 A1 6/2004 Witkowski et al.
2006/0149434 A1 * 7/2006 Bertosa ..... G07C 5/006 701/31.4
2010/0205450 A1 * 8/2010 Sarnacke ..... B60R 25/00 713/185
2014/0046800 A1 2/2014 Chen
2014/0365064 A1 * 12/2014 Pham ..... G07C 5/008 701/29.6
2016/0027223 A1 1/2016 Madison et al.
2016/0104328 A1 4/2016 Chen et al.
2016/0188195 A1 6/2016 Chen
2017/0186054 A1 6/2017 Fish et al.
2018/0101775 A1 4/2018 Fish

* cited by examiner

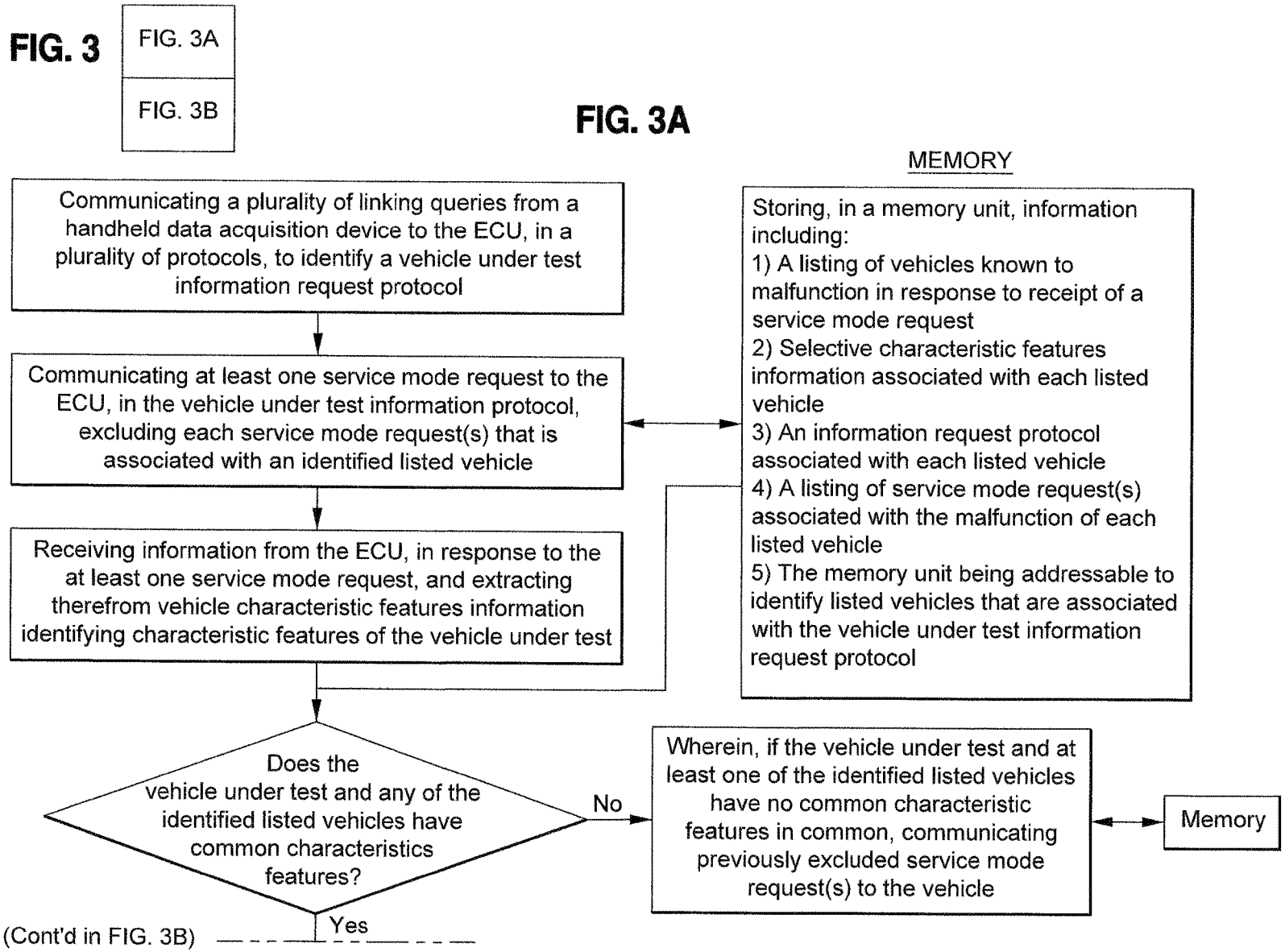
FIG. 3
FIG. 3A
FIG. 3B
MEMORY
Communicating a plurality of linking queries from a handheld data acquisition device to the ECU, in a plurality of protocols, to identify a vehicle under test information request protocol
Communicating at least one service mode request to the ECU, in the vehicle under test information protocol, excluding each service mode request(s) that is associated with an identified listed vehicle
Storing, in a memory unit, information including:
1) A listing of vehicles known to malfunction in response to receipt of a service mode request
2) Selective characteristic features information associated with each listed vehicle
3) An information request protocol associated with each listed vehicle
4) A listing of service mode request(s) associated with the malfunction of each listed vehicle
5) The memory unit being addressable to identify listed vehicles that are associated with the vehicle under test information request protocol
Receiving information from the ECU, in response to the at least one service mode request, and extracting therefrom vehicle characteristic features information identifying characteristic features of the vehicle under test
Does the vehicle under test and any of the identified listed vehicles have common characteristics features?
No
Yes
Wherein, if the vehicle under test and at least one of the identified listed vehicles have no common characteristic features in common, communicating previously excluded service mode request(s) to the vehicle
Memory
(Cont'd in FIG. 3B)

ADAPTIVE VEHICLE MONITORING SYSTEM

CROSS-REFERENCE TO RELATED APPLICATIONS

This application is a continuation of U.S. patent application Ser. No. 15/404,976, filed Jan. 12, 2017, the contents of which are expressly incorporated herein by reference.

STATEMENT RE: FEDERALLY SPONSORED RESEARCH/DEVELOPMENT

Not Applicable

BACKGROUND

The present invention relates to vehicle diagnostic systems and methods, and, more particularly, to devices and methods for adaptively accessing vehicle diagnostic information in a manner to avoid engine specific anomalies.

Since the 1980's, major automobile manufacturers have installed electronic control units (ECU) in vehicles being produced. ECU's generally function to monitor various vehicle conditions and recognize malfunctions or trouble conditions, which may be recorded in the vehicle ECU. Technicians servicing the vehicles have used scan tools, or other equipment that enables them to access the ECU to download vehicle diagnostic trouble codes (DTC's) that would identify the malfunctions or trouble conditions detected by and stored in the ECU.

Since the 1980's, the sophistication of the vehicle ECU's, scan tools and other equipment used to access information in the ECU's has become more sophisticated. The vehicle information accessible by or through the ECU has expanded to include a variety of different types of information, e.g., live information and/or stored information from various vehicle components. Moreover, the processing capability of the ECU, as well as the scan tool, have expanded to allow the technician to more specifically identify vehicle defects by accessing and comparing information received from the vehicle, using sophisticated databases that may be stored or distributed within the ECU, the scan tool, and remote locations, e.g., websites accessible by the scan tool itself, or in association with a digital computing device, such as a computer or cellphone.

In order to facilitate the use of common equipment and communication techniques for accessing information on different vehicles, vehicle original equipment manufacturers (OEMs) utilize one of approximately five different signal protocols for communicating information and commands to or from the ECU. Contemporary scan tools and similar devices commonly connect to the ECU through a vehicle diagnostic port, and operate to poll the ECU, by sequencing through each of the different protocols until the ECU response to one of the protocols. The scan tool will then communicate with the ECU in the identified protocol to request information from the ECU and other vehicle systems.

While the above described ECU interface system generally works well and is a reliable way to access information from the vehicle ECU, anomalies occasionally arise in relation to particular engines. For example, it has been found that certain Ford® vehicles equipped with 7.3 L diesel engines will stall if certain diagnostic information is requested from the vehicle ECU while the vehicle is running, e.g. engines and related electronic controls for the engine are understood to have been produced by Navistar International (engine code T444D) during 1994-2003. This can create a safety condition, particular as that vehicle may be used to tow excessive loads. Since the functionality of hydraulic power assisted braking (Hydro Boost) systems and steering systems are generally dependent upon the engine being operational, a sudden engine stall can be problematical. While OEMs generally take steps to ensure that power and fluid remains available in the event of such a stall, the stored power and fluid under pressure may be very limited, e.g., to power assisted brake applications, which may be insufficient to avoid a dangerous and potentially fatal condition.

The present invention is directed to an apparatus and technique for modifying the manner in which a scan tool, or other diagnostic device, communicates with a vehicle ECU to determine if the vehicle under test is subject to causing an operational anomaly in response to a standard information requests to the vehicle ECU. If so, the present invention functions to modify the information requests in such a manner to be able to avoid the anomaly, i.e., by omitting or modifying the information request that has been found to trigger the anomaly.

BRIEF SUMMARY

A system and method are provided for adaptively accessing information in a vehicle under test, in a manner to avoid malfunctions associated with accessing the information. A data acquisition device is provided for accessing and retrieving diagnostic data from the vehicle. A memory unit is provided including listing of malfunctioning vehicles, as well as information associated with each of the listed vehicles. At least one service mode request is communicated from the data acquisition device to the vehicle to identify characteristic features of the vehicle, which information is compared to stored vehicle characteristic information, to determine if the vehicle conforms to any of the listed vehicles, subject to malfunction. If not, additional service requests are communicated to the vehicle.

More specifically, the system comprises a data acquisition device including a first datalink communicable with the vehicle ECU, for accessing and retrieving diagnostic data from the vehicle under test. The data acquisition device may further include a processor unit, in communication with the first datalink, the processor unit including a data linking module operative to generate linking queries to the ECU, in a plurality of protocols, to identify the information request protocol used by the vehicle under test.

A memory unit is provided in communication with the processor. The memory unit may include: 1) a listing of vehicles known to malfunction in response to receipt of a service mode request; 2) a listing of selective characteristic features information associated with each listed vehicle; 3) an information request protocol associated with each listed vehicle; and 4) a listing of the specific service mode request (s) associated with a malfunction of each listed vehicle. The memory unit is addressable by the processor unit to identify listed vehicles (i.e., vehicles subject to malfunction) that are associated with the vehicle under test information request protocol.

The data acquisition device may further include data retrieval module operative to selectively communicate at least one service request to the ECU, in the vehicle under test information request protocol, excluding each service mode request(s), or portion thereof, that is associated with an identified vehicle.

The data acquisition device may further include a data extraction module operative to receive information from the ECU, in response to the at least one service request, and extract therefrom vehicle characteristic features information, identifying characteristic features of the vehicle under test.

The data acquisition device may further include a comparison module operative to compare the extracted characteristic features information to the selective characteristic features information associated with each of the identified listed vehicles, to determine if the vehicle under test and any of the identified listed vehicles have common characteristic features. If the vehicle under test has no characteristic features in common with any of the identified listed vehicles, the data retrieval unit may be further operative to communicate the previously excluded service mode request(s) to the vehicle under test.

If the vehicle under test and at least one of the identified vehicles have one or more common characteristic features, the data retrieval unit may be operative to communicate additional service mode request to the vehicle under test, excluding any service mode request(s), or portions thereof, associated with at least one of the listed vehicles.

Where the vehicle under test and a plurality of the identified listed vehicles have one or more common characteristic features, the comparison module may be further operative to determine which of the plurality of identified listed vehicles is the closest to the vehicle under test, e.g., which of the identified listed vehicles has the greatest number of characteristic features in common with the vehicle under test. The data retrieval unit is further operative to communicate additional service mode request to the vehicle under test, excluding any service mode request(s), or portion thereof, that is associated with the identified listed vehicle having the greatest number of characteristic features in common with the vehicle under test.

In one embodiment, the first datalink is directly connectable to a data port of a vehicle under test. In another embodiment the first datalink may be wirelessly communicable with the ECU of the vehicle under test.

In one embodiment, the handheld data acquisition device may be implemented as a scan tool. In other embodiments the data acquisition device may be implemented as a smartphone, computer tablet, dongle, or other programmable device that is wirelessly communicable with the ECU.

In one embodiment the memory unit may be disposed within the handheld data acquisition device. In another embodiment, the memory unit may be disposed remote from the handheld data acquisition device, and accessible by the data acquisition device via a second datalink connectable to a global computer network, for transferring information between the data acquisition device and the remote memory unit. The data acquisition device may include the second datalink connectable to the global computer network for transferring information received in response to the service mode requests to a location remote from the device. The step of receiving information from the ECU, in response to the at least one service mode request, and extracting therefrom vehicle characteristic features information identifying characteristic features of the vehicle under test may be implemented in a device located remote from the data acquisition device. The step of comparing the extracted characteristic features information to the selective characteristic features information associated with each of the identified listed vehicles to determine if the vehicle under test and any of the identified listed vehicles have common characteristics features may be implemented in a device located remote from the data acquisition device.

In one embodiment the present invention is implemented in a manner specific to obtaining information from an ECU of a diesel engine vehicle, wherein the diesel engine vehicle is associated with a malfunction arising in response to receipt of a particular service mode request and/or service mode request portion, while the diesel engine is running. Where the vehicle under test is a diesel engine vehicle, and the engine is currently running, service mode requests, or portions thereof, associated with the malfunction in diesel engine vehicles are not communicated to the vehicle under test.

BRIEF DESCRIPTION OF THE DRAWINGS

These and other features and advantages of the various embodiments disclosed herein will be better understood with respect to the following description and drawings, in which like numbers refer to like parts throughout, and in which:

FIGS. 3, 3A, and 3B are flowcharts illustrating an exemplary process implemented by the present invention.

DETAILED DESCRIPTION

The following description is given by way of example, and not limitation. Given the following disclosure, one skilled in the art could devise variations that are within the scope and spirit of the invention disclosed herein, including various alternate ways of retrieving, processing and operating on vehicle diagnostic information, in accordance with the present invention. Further, the various modules and features of the embodiments disclosed herein can be used alone, or in varying combinations with each other and are not intended to be limited to the specific combination described herein. Thus, the scope of the claims is not to be limited by the illustrated embodiments.

Figure 1:
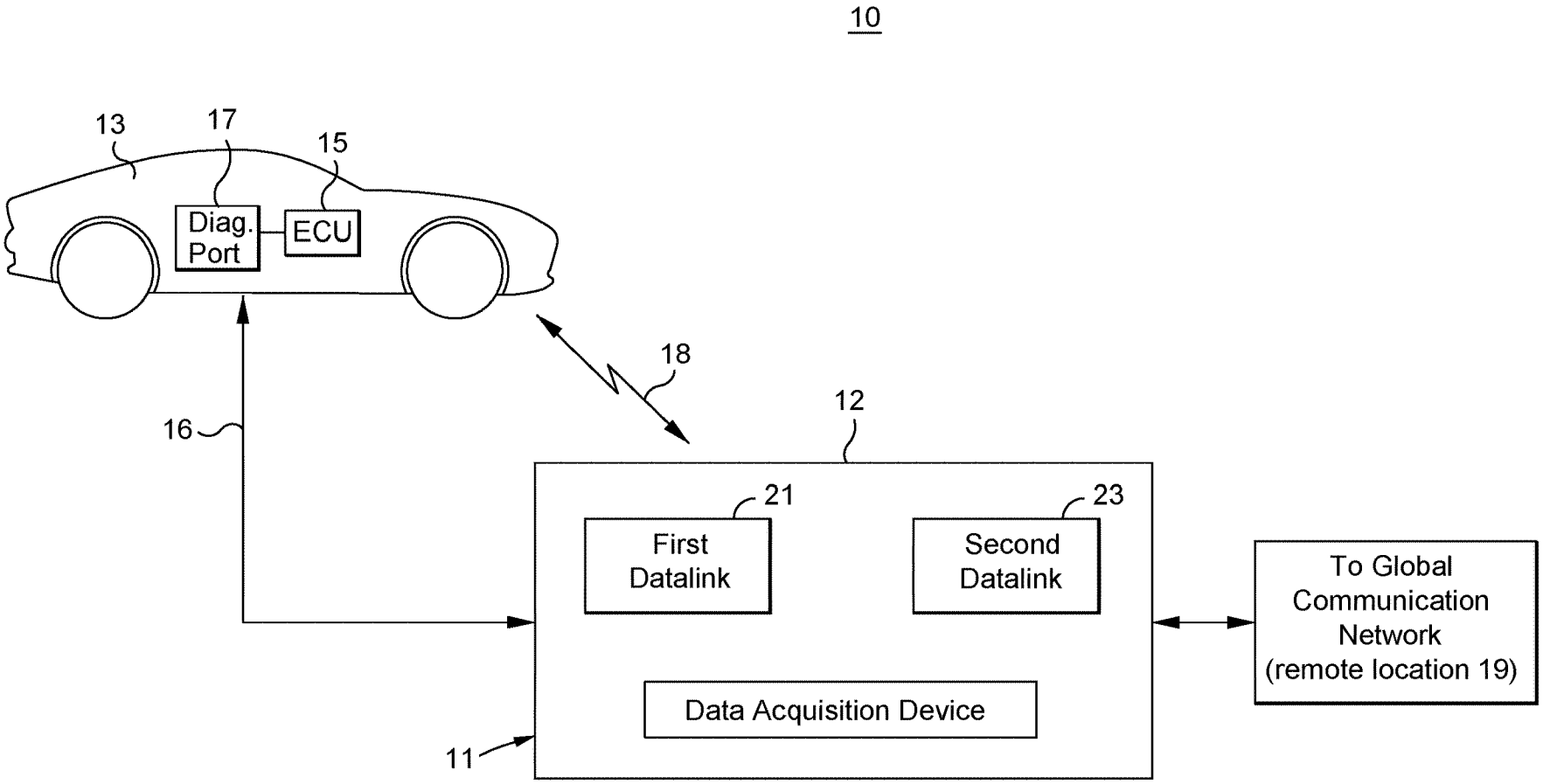
FIG. 1 illustrates an exemplary operating environment of the present invention.

FIG. 1 illustrates an operating environment in which the present invention finds application. In accordance with the present invention the adaptive vehicle monitoring system 10 uses a data acquisition device 11 to communicate with vehicle 13, to obtain diagnostic information concerning the status and operating condition of vehicle systems. The data acquisition device 11 includes a housing 12, as well as a first datalink 21 which may communicate with the vehicle's ECU 15 via hard wired link 16 to the vehicle diagnostic port 17. Alternatively, the data acquisition device may communicate with the vehicle electronic control unit (ECU) 15 via wireless datalink 18. Information received from the vehicle 13 is processed within the data acquisition device, as described in more detail below.

The data acquisition device 11 may further include a second datalink 23, that is communicable with the remote location 19 via a global computer network or by another communications link.

The data acquisition device 11 may be implemented as a scan tool arranged in programs to implement the present invention, as described more fully below. Alternatively, the data acquisition device 11 may be implemented as a smartphone, tablet computer, dongle, or other computing device operative to implement the functions of the present invention, as described more fully below.

In general, the data acquisition device functions in a manner similar to a conventional scan tool, in relation to the basic functionality of the present invention. However, the present invention departs from conventional scan tool operations in the manner in which the data acquisition device selectively retrieves and processes data in the manner to avoid vehicle malfunctions that may arise during implementation of the conventional vehicle monitoring process in certain vehicles. In essence, the present invention modifies the conventional vehicle diagnostic system and methodology to adapt to anomalous operating conditions in certain vehicles. As described in more detail below, the present invention retrieves certain limited data from the vehicle ECU, to allow the data acquisition device 11 to determine the operating characteristics of the vehicle 13, and evaluate whether or not the vehicle is subject to such anomalous conditions. If so, the present invention proceeds with the vehicle diagnostic process in a manner that avoids triggering malfunctions known to be present in the vehicle.

Figure 2:
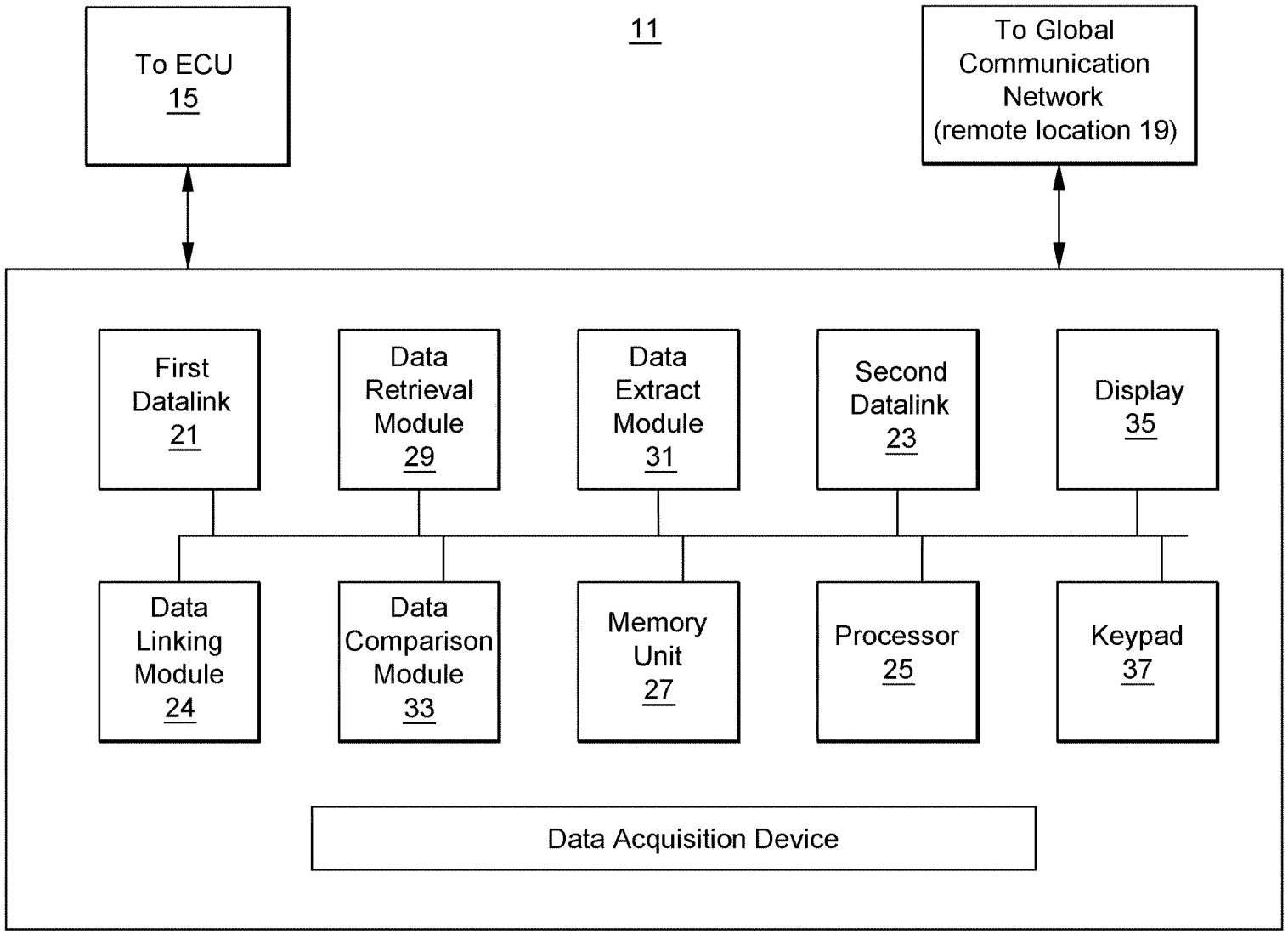
FIG. 2 is a block diagram illustrating the functional components of the data acquisition device in accordance with the present invention.
Figure 3B:
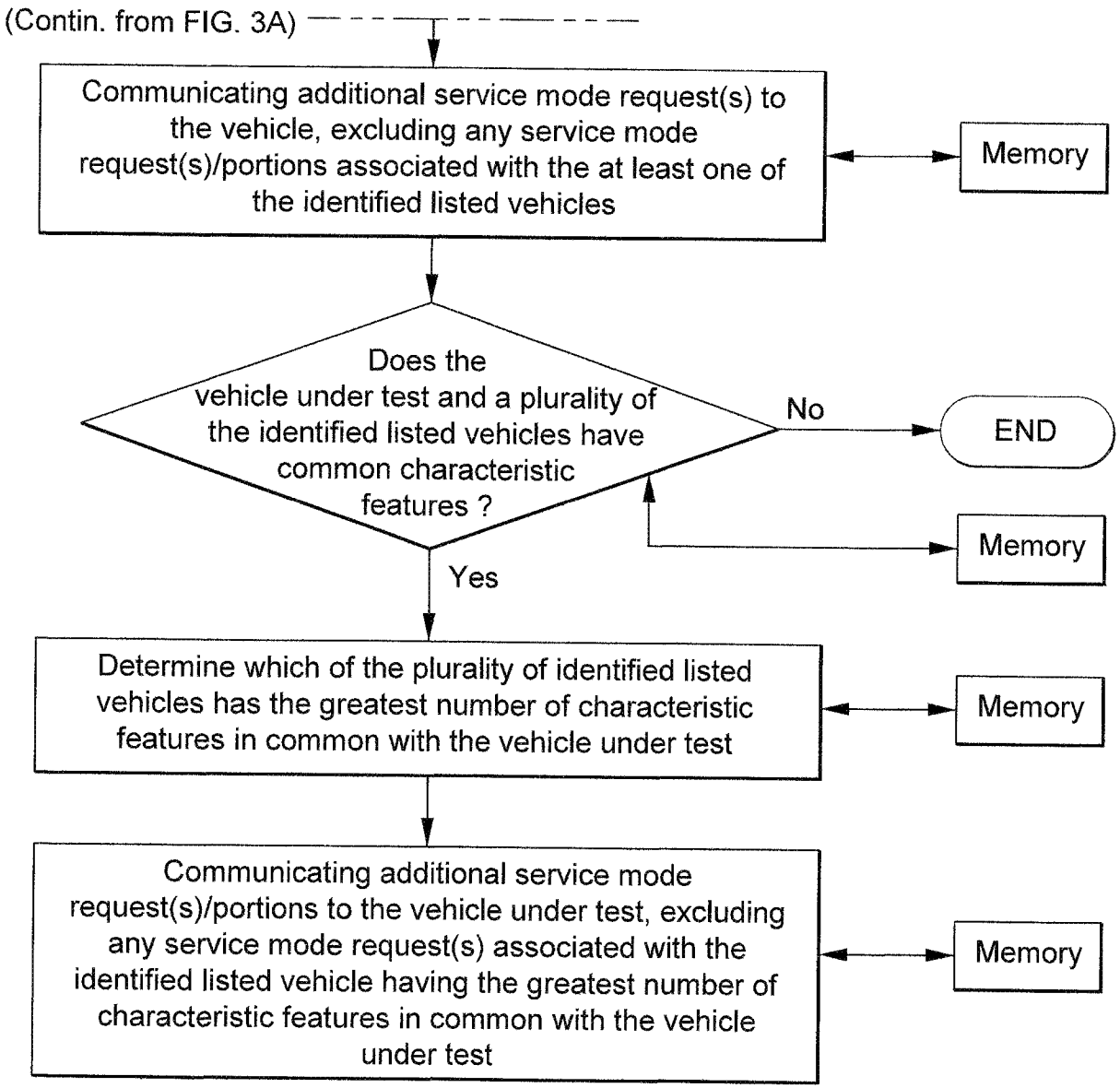

FIG. 2 is a block diagram illustrating the primary functional modules of the exemplary data acquisition device 11. The operation of the data acquisition device 11 will be described, in combination with the flowchart set forth at FIG. 3.

It is to be understood that numerous modules of the data acquisition device, including but not limited to the data retrieval module 29, the data extraction module 31, and the data comparison module 33 may be implemented in software programming, operated on by microprocessor 25. However, the modules are illustrated separately in order to more clearly differentiate the functionality of the modules.

Referring to FIG. 2, the data acquisition device 11 includes a first datalink 21 communicable with the ECU 15 of vehicle 13, for accessing and retrieving diagnostic data from the vehicle 13. A processor unit 25 is in communication with the first datalink and includes data linking module 24, operative to generate linking queries for communication to the ECU 15 in a plurality of protocols, to identify the information request protocol of the vehicle 13.

Memory unit 27 is also in communication with the processor 25. The memory unit includes information stored therein including: 1) a listing of vehicles known to malfunction in response to receipt of a service mode request for diagnostic information from the vehicle; 2) a listing of selective characteristic features information associated with each listed vehicle; 3) an information request protocol associated with each listed vehicle; and 4) a listing of specific service mode request(s) associated with a malfunction of each listed vehicle. The memory unit 27 is addressable by processor 25 to identify listed vehicles that are associated with the vehicle under test information request protocol.

The data acquisition device may further include a data retrieval module 29, operative to selectively communicate at least one service mode request to the ECU, in the vehicle under test information request protocol, excluding each service mode request(s) that is associated with an identified listed vehicle.

The data acquisition device 11 may further include a data extraction module 31 operative to receive information from the ECU, in response to the at least one service mode request, and to extract therefrom vehicle characteristic features information, identifying characteristic features of the vehicle under test.

The data acquisition module may further include a data comparison module 33, operative to compare the extracted characteristic features information to the selective characteristic features information associated with each of the identified listed vehicles, to determine if the vehicle under test and any of the identified listed vehicles have common characteristic features. Where the vehicle under test and the identified listed vehicles have no common characteristic features, the data retrieval unit 29 is further operative to communicate any previously excluded service mode requests and the request(s) to the vehicle under test. As shown in FIG. 2, the data acquisition device 11 may also include a display 35 and keypad 37.

Where the vehicle under test and at least one of the identified listed vehicles have one or more common characteristic features, the data retrieval unit is further operative to communicate additional service mode request(s) to the vehicle under test, excluding any service mode request, or portion thereof, that is associated with at least one of the identified listed vehicles.

Where the vehicle under test and a plurality of the identified listed vehicles have one or more common characteristic features, the data comparison module 33 is further operative to determine which of the plurality of identified listed vehicles most closely conforms to the vehicle under test, e.g., which of the identified vehicles has the greatest number of characteristic features in common with the vehicle under test. The data retrieval module is then further operative to communicate additional service mode requests to the vehicle under test, excluding service mode requests associated with the closest identified listed vehicle, e.g., the identified listed vehicle having the greatest number of characteristic features in common with the vehicle under test.

As noted above, the memory unit 27 may be disposed within the data acquisition device 11, or located at remote locations 19, which may be addressable via a global communication network.

As noted above, the present invention may be implemented in a broadly adaptive manner, as described above, or may be implemented in a more specifically adapted manner, to address specific malfunctions, such as malfunctions associated with accessing information from a diesel engine, while the engine is running. As noted above, potential safety issues may arise where certain diesel engine vehicles receive a service mode nine request, which requests a vehicle identification number (VIN) and other information from the powertrain control module (PCM) while the engine is running. This may cause the functioning engine to stall. The 7.3 L engine was available on three-quarter ton and larger trucks and vans during model year 1994 to 2003. As explained further below, the present invention modifies the sequence and/or substances of service mode requests to the ECU where if the information received from the ECU indicates that the vehicle is a diesel engine that is running. The scan tool or similar equipment will omit a service call for service mode nine from the sequence of service modes that service mode calls communicated to the ECU. Accordingly, as described above, the data acquisition device is adaptive to be able to recognize vehicles subject to anomalous conditions, arising thereof, as a result of service mode calls to the ECU, and to adapt the service mode calls, and the sequence to avoid triggering such anomalies.

Figure 4:
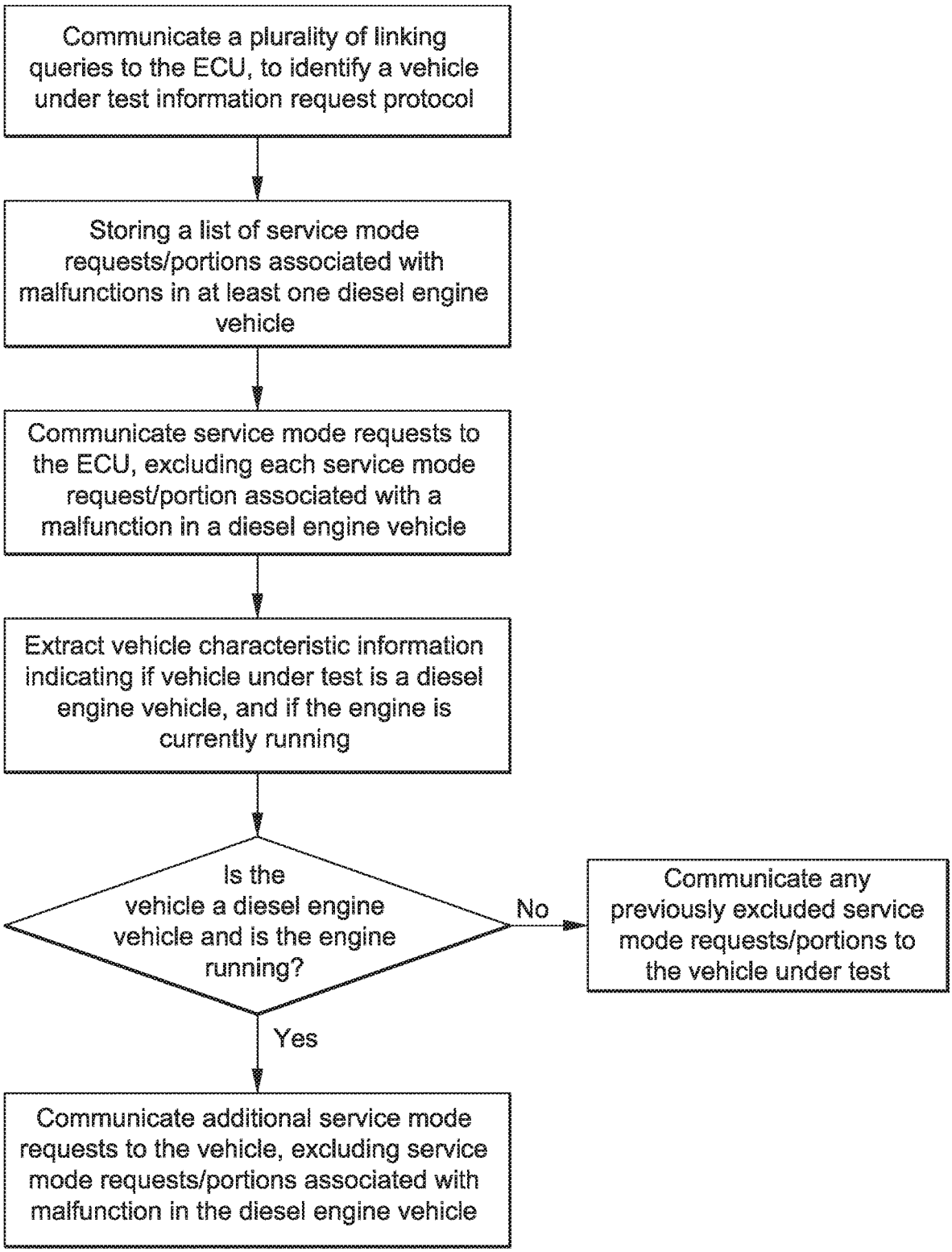
FIG. 4 is a flowchart illustrating an alternate exemplary process implemented by the present invention.

FIG. 4 illustrates a process that may be implemented to access information in the ECU of a diesel engine vehicle, to avoid such a malfunction. The process may similarly be implemented on a handheld data acquisition device, such as a scan tool, smartphone, tablet computer or other computing device. The process again begins by communicating a plurality of linking queries to the vehicle ECU 15, in a plurality of protocols, to identify the vehicle under test information request protocol.

Information is stored in a memory unit listing service mode requests, and/or portions thereof associated with malfunction in at least one diesel engine vehicle.

At least one service mode request is communicated to the ECU, in the vehicle under test information request protocol, excluding each service mode request, or portion thereof, associated with a malfunction in the diesel engine vehicle. In response to the at least one service mode request, information is received from the ECU, and vehicle characteristic information is extracted therefrom, indicating if the vehicle under test is a diesel engine vehicle, and if the engine is currently running. If the vehicle is a diesel engine vehicle, and is currently running, additional service mode requests, or portions thereof, may be communicated to the vehicle ECU, excluding any service mode request, or portion thereof, that is associated with a malfunction in the diesel engine vehicle.

What is claimed is:

1. A vehicle monitoring system for adaptively accessing information in an electronic control unit (ECU) of a vehicle under test, in a manner to avoid vehicle malfunctions associated with accessing the information, the system comprising:

a) a handholdable data acquisition device including:

1) a first datalink communicable with the ECU of the vehicle under test for accessing and retrieving diagnostic data from the vehicle under test;

2) a processor unit in communication with the first datalink;

3) a data linking module operative to generate linking queries to the ECU in a plurality of protocols, to identify a vehicle under test information request protocol; and 4) a housing within which the first datalink, the processor unit, and the data linking module are at least partially located; and b) a memory unit in communication with the processor unit, the memory unit having information stored therein including:

1) a listing of vehicles known to malfunction in response to receipt of a service mode request;

2) a listing of selective characteristic features information associated with each listed vehicle of the listing of vehicles;

3) an information request protocol associated with each listed vehicle of the listing of vehicles; and 4) a listing of at least one specific service mode request associated with a malfunction of each listed vehicle of the listing of vehicles;

the memory unit being accessible by the processor unit to identify listed vehicles, among the listing of vehicles, that are associated with the vehicle under test information request protocol;

c) the handholdable data acquisition device further including a data retrieval module operative to selectively communicate at least one service mode request to the ECU, in the vehicle under test information request protocol, excluding each service mode request that is associated with an identified listed vehicle, among the listing of vehicles;

d) the handholdable data acquisition device further including a data extraction module operative to receive information from the ECU, in response to the at least one service mode request, and extract therefrom vehicle characteristic features information, identifying characteristic features of the vehicle under test; and e) the handholdable data acquisition device further including a comparison module operative to compare the extracted characteristic features information to the selective characteristic features information associated with each of the identified listed vehicles, to determine if the vehicle under test and any of the identified listed vehicles have common characteristics features;

f) wherein, when the vehicle under test has no characteristics features in common with any of the identified listed vehicles, the data retrieval module is further operative to communicate each previously excluded service mode request to the vehicle under test.

2. The vehicle monitoring system as recited in claim 1 wherein, when the vehicle under test and at least one of the identified listed vehicles have one or more in common characteristic features, the data retrieval module is further operative to communicate additional at least one service mode request to the vehicle under test, excluding any service mode request associated with the at least one of the identified listed vehicles.

3. The vehicle monitoring system recited in claim 2 wherein when the vehicle under test and a plurality of the identified listed vehicles have one or more in common characteristic features, the comparison module is further operative to determine which of the plurality of identified listed vehicles has the greatest number of characteristic features in common with the vehicle under test, and the data retrieval module is further operative to communicate additional service mode requests to the vehicle under test, excluding service mode requests associated with the identified listed vehicle having the greatest number of characteristics features in common with the vehicle under test.

4. The vehicle monitoring system as recited in claim 1 wherein the processor unit is communicable with the memory unit to identify any listed vehicle subject to malfunction in response to service mode requests under the identified protocol, and characteristics features associated with any identified listed vehicle.

5. The vehicle monitoring system recited in claim 1 wherein the first datalink is connectable to a data port of the vehicle under test.

6. The vehicle monitoring system as recited in claim 1 wherein the first datalink is wirelessly communicable with the ECU.

7. A vehicle monitoring system for adaptively accessing information in an electronic control unit (ECU) of a vehicle under test, in a manner to avoid vehicle malfunctions associated with accessing the information, the system comprising:

a) a handholdable data acquisition device operative to generate linking queries to the ECU in a plurality of protocols, to identify a vehicle under test information request protocol, the handholdable data acquisition device having a processor unit;

b) a memory unit in communication with the handholdable data acquisition device, the memory unit having:

a listing of vehicles known to malfunction in response to receipt of a service mode request; and an information request protocol associated with each listed vehicle of the listing of vehicles;

the memory unit being accessible by the processor unit to identify listed vehicles, among the listing of vehicles, that are associated with the vehicle under test information request protocol such that any service mode requests that are associated with a malfunction of the identified listed vehicles are excluded from being communicated with the ECU;

c) the handholdable data acquisition device further operative to communicate at least one service mode request to the ECU, in the identified information request protocol, excluding each service mode request that is associated with an identified listed vehicle of the identified listed vehicles;

d) the handholdable data acquisition device further operative to identify vehicle characteristic features information of the vehicle under test based on extracting information received from the ECU in response to the at least one service mode request communicated to the ECU; and e) the handholdable data acquisition device further operative to determine if the vehicle under test and any of the identified listed vehicles have common characteristics features;

f) wherein, when the vehicle under test has no characteristics features in common with any of the identified listed vehicles, the handholdable data acquisition device is further operative to communicate each previously excluded service mode request to the vehicle under test.

8. The vehicle monitoring system as recited in claim 7, wherein the memory unit is remotely located from the handholdable data acquisition device.

9. The vehicle monitoring system as recited in claim 8, wherein the handholdable data acquisition device includes a second datalink connectable to a global computer network for transferring information received in response to the service mode requests to a location remote from the handholdable data acquisition device.

10. The vehicle monitoring system as recited in claim 7, wherein, when the vehicle under test and at least one of the identified listed vehicles have one or more in common characteristic features, the handholdable data acquisition device is further operative to communicate at least one additional service mode request to the vehicle under test, excluding any service mode request associated with the at least one of the identified listed vehicles.

11. The vehicle monitoring system as recited in claim 10, wherein, when the vehicle under test and a plurality of the identified listed vehicles have one or more in common characteristic features, the handholdable data acquisition device is further operative to determine which of the plurality of identified listed vehicles has the greatest number of characteristic features in common with the vehicle under test, and to communicate additional service mode requests to the vehicle under test, excluding service mode requests associated with the identified listed vehicle having the greatest number of characteristics features in common with the vehicle under test.

12. The vehicle monitoring system as recited in claim 7, wherein the processor unit is communicable with the memory unit to identify any listed vehicle subject to malfunction in response to service mode requests under the identified protocol, and characteristics features associated with any identified listed vehicle.

13. The vehicle monitoring system as recited in claim 7, wherein the handholdable data acquisition device is connectable to a data port of the vehicle under test.

14. The vehicle monitoring system as recited in claim 7, wherein the handholdable data acquisition device is wirelessly communicable with the ECU.

15. The vehicle monitoring system as recited in claim 7, wherein the memory unit is disposed within the handholdable data acquisition device.

16. A method of accessing information from an electronic control unit (ECU) of a vehicle under test, in a manner to avoid vehicle malfunctions associated with accessing information in the ECU of diesel engine vehicles, the method comprising:

communicating a plurality of queries to the ECU, in a plurality of protocols, to identify an information request protocol of the vehicle under test;

communicating at least one service mode request to the ECU, excluding each service mode request and portions thereof that are associated with causing a malfunction in a diesel engine vehicle; and receiving information from the ECU, in response to the at least one service mode request, and extracting therefrom vehicle characteristic information in order to determine whether the vehicle under test is a diesel engine vehicle and whether a diesel engine of the diesel engine vehicle is currently running;

wherein, when the vehicle under test is identified as the diesel engine vehicle and the diesel engine is currently running, communicating at least one additional service mode request to the vehicle under test, excluding any service mode requests and service mode request portions associated with the malfunction in the diesel engine vehicle.

17. The method as recited in claim 16 wherein, when the vehicle under test is not a diesel engine vehicle, or when the diesel engine is not running, the method further comprises communicating any previously excluded service mode requests and service mode request portions to the vehicle under test.

18. A method of accessing information in an electronic control unit (ECU) of a vehicle under test, the method comprising:

a) communicating a plurality of linking queries from a handheld data acquisition device to the ECU, to identify a vehicle under test information request protocol;

b) storing, in a memory unit, information including:

1) a listing of vehicles known to malfunction in response to receipt of a service mode request;

2) selective characteristic features information associated with each listed vehicle of the listing of vehicles;

3) an information request protocol associated with each listed vehicle of the listing of vehicles; and 4) a listing of at least one service mode request associated with the malfunction of each listed vehicle of the listing of vehicles;

the memory unit being addressable to identify listed vehicles, among the listing of vehicles, that are associated with the vehicle under test information request protocol;

identifying listed vehicles, among the listing of vehicles, that are associated with the vehicle under test information request protocol;

d) communicating at least one service mode request to the ECU, in the vehicle under test information protocol, excluding each service mode request that is associated with an identified listed vehicle of the identified listed vehicle;

e) receiving information from the ECU, in response to the at least one service mode request, and extracting therefrom vehicle characteristic features information identifying characteristic features of the vehicle under test;

f) comparing the extracted characteristic features information to the selective characteristic features information associated with each of the identified listed vehicles to determine if the vehicle under test and any of the identified listed vehicles have common characteristics features; and g) wherein, when the vehicle under test and at least one of the identified listed vehicles have no common characteristic features in common, communicating each of the one or more previously excluded service mode requests to the vehicle under test.

19. The method as recited in claim 18, wherein steps b), e), and f) are implemented in a device located remote from the handheld data acquisition device.

20. The method as recited in claim 18, wherein steps b), e), and f) are implemented in the handheld data acquisition device.

21. An automotive diagnostic system for use with a handheld electronic device for accessing information from an electronic control unit (ECU) of a vehicle under test, in a manner to avoid vehicle malfunctions associated with accessing information in the ECU of diesel engine vehicles, the automotive diagnostic system comprising:

a computer including computer readable instructions downloadable onto the handheld electronic device for configuring the handheld electronic device to:

communicate a plurality of queries to the electronic control unit (ECU), in a plurality of protocols, to identify an information request protocol of the vehicle under test;

communicate at least one service mode request to the ECU, excluding each service mode request and portions thereof that are associated with causing a malfunction in a diesel engine vehicle; and receive information from the ECU, in response to the at least one service mode request, and extract therefrom vehicle characteristic information in order to determine whether the vehicle under test is a diesel engine vehicle and whether a diesel engine of the diesel engine vehicle is currently running;

wherein, when the vehicle under test is identified as the diesel engine vehicle and the diesel engine is currently running, communicating at least one additional service mode request to the vehicle under test, excluding any service mode requests and service mode request portions associated with the malfunction in the diesel engine vehicle.

22. A method of accessing information in an electronic control unit (ECU) of a vehicle under test, the method comprising:

a) communicating a plurality of linking queries from a data acquisition device to the ECU, to identify a vehicle under test information request protocol;

b) storing, in a memory unit, information including:

1) a listing of vehicles known to malfunction in response to receipt of a service mode request;

2) selective characteristic features information associated with each listed vehicle of the listing of vehicles;

3) an information request protocol associated with each listed vehicle of the listing of vehicles; and 4) a listing of at least one service mode request associated with the malfunction of each listed vehicle of the listing of vehicles;

the memory unit being addressable to identify listed vehicles, among the listing of vehicles, that are associated with the vehicle under test information request protocol;

c) identifying listed vehicles, among the listing of vehicles, that are associated with the vehicle under test information request protocol;

d) communicating at least one service mode request to the ECU, in the vehicle under test information protocol, excluding each service mode request that is associated with an identified listed vehicle of the identified listed vehicles;

e) receiving information from the ECU, in response to the at least one service mode request, and extracting therefrom vehicle characteristic features information identifying characteristic features of the vehicle under test;

f) comparing the extracted characteristic features information to the selective characteristic features information associated with each of the identified listed vehicles to determine if the vehicle under test and any of the identified listed vehicles have common characteristics features; and g) wherein, when the vehicle under test and at least one of the identified listed vehicles have no common characteristics features in common, communicating each of the one or more previously excluded service mode requests to the vehicle under test.

23. The method as recited in claim 22, wherein steps b), e), and f) are implemented in a device located remote from the data acquisition device.

24. An automotive diagnostic system for use with an electronic device for accessing information from an electronic control unit (ECU) of a vehicle under test, in a manner to avoid vehicle malfunctions associated with accessing information in the ECU of diesel engine vehicles, the automotive diagnostic system comprising:

a computer including computer readable instructions downloadable onto the electronic device for configuring the electronic device to:

communicate a plurality of queries to the electronic control unit (ECU), in a plurality of protocols, to identify an information request protocol of the vehicle under test;

communicate at least one service mode request to the ECU, excluding each service mode request and portions thereof that are associated with causing a malfunction in a diesel engine vehicle; and receive information from the ECU, in response to the at least one service mode request, and extract therefrom vehicle characteristic information in order to determine whether the vehicle under test is a diesel engine vehicle and whether a diesel engine of the diesel engine vehicle is currently running;

wherein, when the vehicle under test is identified as the diesel engine vehicle and the diesel engine is currently running, communicating at least one additional service mode request to the vehicle under test, excluding any service mode requests and service mode request portions associated with the malfunction in the diesel engine vehicle.

* * * * *